US008920075B2

(12) United States Patent
Bishop

(10) Patent No.: US 8,920,075 B2
(45) **Date of Patent: *Dec. 30, 2014**

(54) MARINE BARRIER AND GATE

(75) Inventor: Justin Bishop, West Caldwell, NJ (US)

(73) Assignee: Halo Maritime Defense Systems, Inc., Andover, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/586,270

(22) Filed: Aug. 15, 2012

(65) Prior Publication Data

US 2013/0119334 A1 May 16, 2013

Related U.S. Application Data

(60) Provisional application No. 61/573,099, filed on Sep. 1, 2011, provisional application No. 61/628,620, filed on Nov. 3, 2011.

(51) Int. Cl.

| | |
|---|---|
| ***F41H 11/05*** | (2006.01) |
| ***E02B 3/04*** | (2006.01) |
| ***E02B 7/20*** | (2006.01) |
| ***B63G 9/04*** | (2006.01) |

(52) U.S. Cl.

CPC ... *E02B 3/04* (2013.01); *E02B 7/20* (2013.01); *B63G 9/04* (2013.01)

USPC ..... 405/211; 114/241

(58) Field of Classification Search

CPC ..... F41H 11/05; B63G 9/40; E02B 3/04; E02B 3/062; E02B 7/20

USPC ..... 405/21, 60, 211, 212; 114/241, 240 R, 114/240 A, 240 B, 240 E; 256/13.1

See application file for complete search history.

(56) References Cited

U.S. PATENT DOCUMENTS

| | | | |
|---|---|---|---|
| 2,693,161 | A | 11/1954 | Stubbs |
| 3,499,291 | A | 3/1970 | Mikkelsen |

(Continued)

FOREIGN PATENT DOCUMENTS

| | | |
|---|---|---|
| WO | 02/26019 | 4/2002 |

OTHER PUBLICATIONS

International Search Report and Written Opinion issued in International Patent Application No. PCT/US2012/053094 mailed Nov. 20, 2012.

(Continued)

*Primary Examiner* — Benjamin Fiorello

(74) *Attorney, Agent, or Firm* — Miles & Stockbridge P.C.; Michael A. Messina

(57) ABSTRACT

A marine barrier has substantially vertical panels, each having a buoyant portion, and a plurality of hinges, each hinge for elastically connecting a side of a first one of the panels to a side of an adjacent second one of the panels with an included angle therebetween, to form a buoyant continuous pleated row of panels, with the hinges arranged in first and second substantially parallel rows. An impact cable is attached to opposing ends of the pleated row of panels passing through each of the hinges in the first row of hinges. When the barrier is floating in water and a moving vessel impacts the impact cable, the impact cable deflects to transfer a force of the impact to one or more of the panels, which in turn engage the water to transfer the force of the impact to the water, to arrest the motion of the vessel.

20 Claims, 17 Drawing Sheets

(56) References Cited

U.S. PATENT DOCUMENTS

| | | | | |
|---|---|---|---|---|
| 3,604,389 | A | 9/1971 | Roberts et al. | |
| 3,823,680 | A | 7/1974 | Straumsnes | |
| 3,864,049 | A | 2/1975 | Ono | |
| 4,033,137 | A | 7/1977 | Geist | |
| 4,174,185 | A | 11/1979 | Toki | |
| 4,272,214 | A | 6/1981 | Nyfeldt et al. | |
| 4,319,858 | A | 3/1982 | Jaffrennou et al. | |
| 4,425,053 | A | 1/1984 | Muto et al. | |
| 5,062,739 | A * | 11/1991 | Klockner | 405/21 |
| 5,141,359 | A | 8/1992 | Klockner | |
| 5,429,452 | A | 7/1995 | Frost | |
| 5,651,709 | A | 7/1997 | Nandakumar et al. | |
| 5,827,011 | A | 10/1998 | Kann | |
| 6,102,616 | A | 8/2000 | Foote | |
| 6,591,774 | B2 | 7/2003 | Metherell et al. | |
| 6,655,641 | B2 | 12/2003 | Sherman et al. | |
| 6,843,197 | B1 | 1/2005 | Nixon et al. | |
| 6,860,209 | B2 | 3/2005 | Errol | |
| 6,877,456 | B2 | 4/2005 | Metherell et al. | |
| 6,886,484 | B2 | 5/2005 | Thomas | |
| 6,960,047 | B2 | 11/2005 | Knezek et al. | |
| 6,980,483 | B2 | 12/2005 | McDonald | |
| 7,140,599 | B1 | 11/2006 | Spink | |
| 7,401,565 | B2 | 7/2008 | Nixon et al. | |
| 7,451,527 | B2 | 11/2008 | Pearce et al. | |
| 7,481,176 | B2 | 1/2009 | Pratt et al. | |
| 7,524,139 | B2 | 4/2009 | Bishop | |
| 7,524,140 | B2 | 4/2009 | Bishop | |
| 7,572,083 | B1 | 8/2009 | Bishop et al. | |
| 7,726,910 | B2 | 6/2010 | Foo et al. | |
| 7,744,313 | B2 * | 6/2010 | Terai et al. | 405/211 |
| 7,887,254 | B2 | 2/2011 | Bishop | |
| 7,975,639 | B2 | 7/2011 | Bishop | |
| 8,007,202 | B2 | 8/2011 | Davis et al. | |
| 8,020,836 | B2 | 9/2011 | Bishop | |
| 2003/0190191 | A1 | 10/2003 | Clark | |
| 2004/0018055 | A1 * | 1/2004 | Clark et al. | 405/26 |
| 2004/0018060 | A1 | 1/2004 | Knezek et al. | |
| 2004/0115002 | A1 | 6/2004 | Meeks et al. | |
| 2005/0013668 | A1 | 1/2005 | Nixon et al. | |
| 2005/0058509 | A1 | 3/2005 | Steinberg | |
| 2005/0191129 | A1 * | 9/2005 | Yodock et al. | 405/63 |
| 2006/0034668 | A1 | 2/2006 | Knezek et al. | |
| 2006/0037526 | A1 | 2/2006 | Knezek et al. | |
| 2008/0105184 | A1 | 5/2008 | Nixon | |
| 2008/0267717 | A1 * | 10/2008 | Meyers et al. | 405/212 |
| 2008/0279631 | A1 | 11/2008 | Bishop | |
| 2009/0035068 | A1 | 2/2009 | Terai et al. | |
| 2009/0090059 | A1 | 4/2009 | Bishop | |
| 2010/0059728 | A1 | 3/2010 | Bishop | |
| 2010/0178109 | A1 | 7/2010 | Wilson | |
| 2010/0239374 | A1 * | 9/2010 | Davis et al. | 405/215 |
| 2013/0108368 | A1 * | 5/2013 | Bishop | 405/63 |

OTHER PUBLICATIONS

International Search Report and Written Opinion issued in International Patent Application No. PCT/US2012/052655 mailed Nov. 6, 2012.

International Preliminary Report dated Mar. 4, 2014, in PCT/US2012/053094.

* cited by examiner

MARINE BARRIER AND GATE

RELATED APPLICATIONS

This application claims the benefit of U.S. Provisional Application No. 61/573,099, filed Sep. 1, 2011, entitled "Rapidly Deployed Marine Barrier and Gate," and U.S. Provisional Application No. 61/628,620, filed Nov. 3, 2011, entitled "Guardian Gate," the disclosures of which are entirely incorporated herein by reference.

TECHNICAL FIELD

The present subject matter relates to marine barriers and movable gates. The present disclosure has particular applicability to marine barriers for arresting the motion of a vessel impacting the barrier.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect as and where desired. Second, they are difficult, or even impossible, to maintain, and/or repair after they have sustained the impact of an intruding object. Third, they are often not adaptable to different needs and conditions.

Therefore, a need exist for improved security barriers and security barrier systems which remain effective while overcoming such shortcomings.

SUMMARY

The present disclosure provides a security barrier system that addresses the aforementioned problems, and provides an improved security barrier system and components thereof for maritime use.

According to the present disclosure, a marine barrier comprises a first plurality of substantially vertical panels, each of the panels having a buoyant bottom portion and a pair of opposing sides; a plurality of hinges, each hinge for elastically connecting a side of a first one of the panels to a side of an adjacent second one of the panels with an included angle therebetween, to form a buoyant continuous first pleated row of panels, such that the hinges are arranged in first and second substantially parallel rows; and an impact cable attached to opposing ends of the first pleated row of panels and passing through each of the hinges in the first row of hinges. When the barrier is floating in a body of water and a moving vessel impacts the impact cable, the impact cable deflects to transfer a force of the impact to one or more of the first plurality of panels, which in turn engage the water to transfer the force of the impact to the water, to arrest the motion of the vessel.

In accord with another aspect of the disclosure, a plurality of hinges of the second row of hinges are inboard hinges, each of which are also for elastically connecting a side of an additional one of the panels to a side of an adjacent further additional one of the panels with the included angle therebetween. In this aspect of the disclosure, the barrier further comprises a third row of hinges substantially parallel to the second row of hinges; a second plurality of the panels, each of which has its pair of opposing sides respectively connected to hinges of the second and third row of hinges to form a second continuous pleated row of panels; and a second impact cable attached to opposing ends of the second pleated row of panels and passing through each of the hinges in the third row of hinges. When the barrier is floating in the body of water and a moving vessel impacts the second impact cable, the second impact cable deflects to transfer a force of the impact to one or more of the second plurality of panels, which in turn engage the water, and to one or more of the first plurality of panels, which in turn engage the water, to transfer the force of the impact to the water and arrest the motion of the vessel.

Additional advantages and other features of the present disclosure will be set forth in part in the description which follows and in part will become apparent to those having ordinary skill in the art upon examination of the following or may be learned from the practice of the invention. The advantages of the disclosure may be realized and obtained as particularly pointed out in the appended claims.

BRIEF DESCRIPTION OF THE DRAWINGS

Reference is made to the attached drawings, wherein elements having the same reference numeral designations represent like elements throughout, and wherein.

DETAILED DESCRIPTION

Figure 4A:
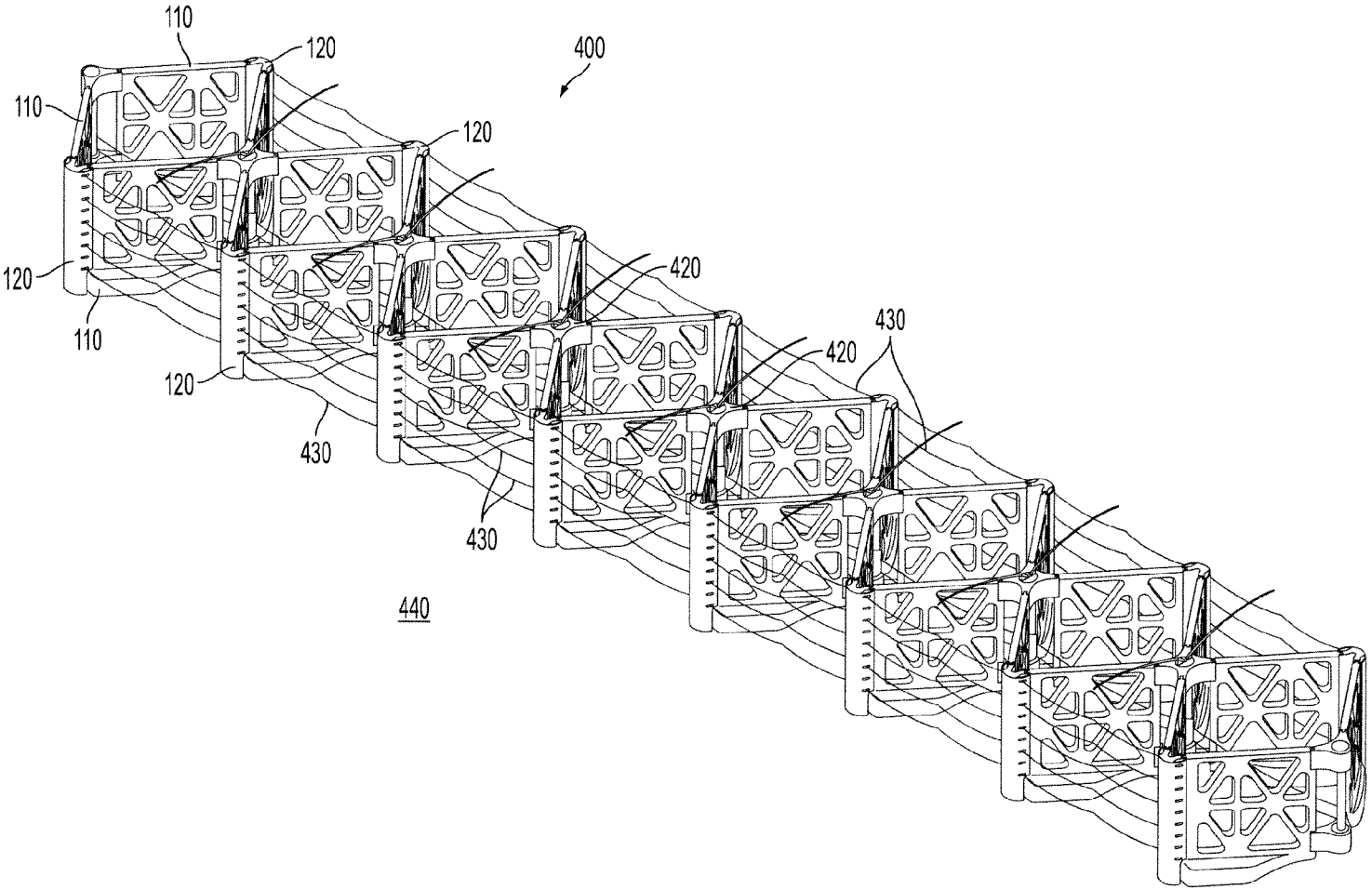
FIGS. 4*a* and 4*e* are perspective views of a barrier according to a further embodiment of the present disclosure.
Figure 4B:
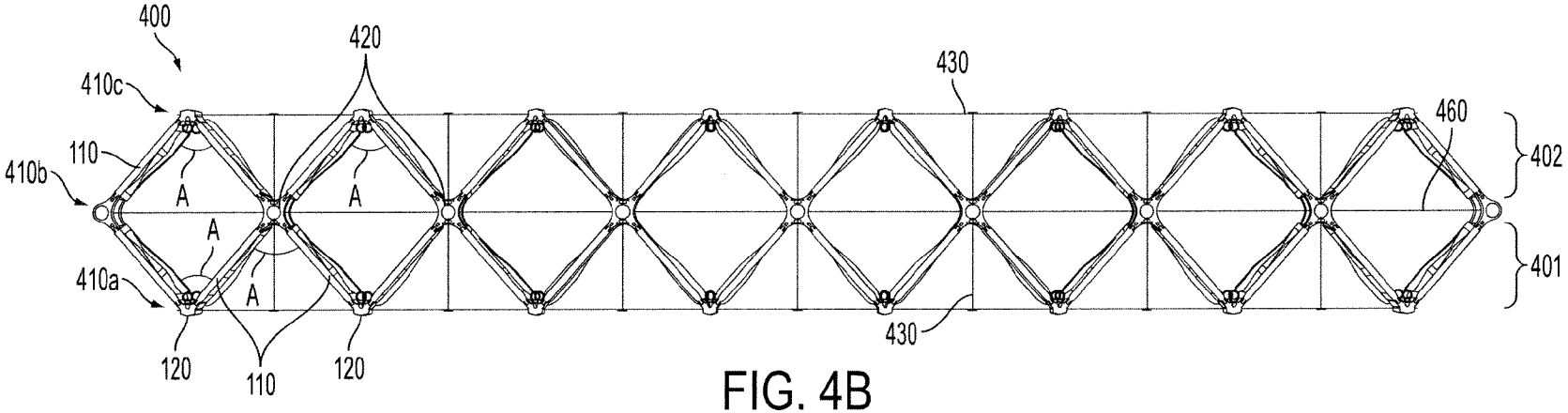
FIGS. 4*b* and 4*d* are top views of the barrier of FIG. 4*a*.
Figure 4C:
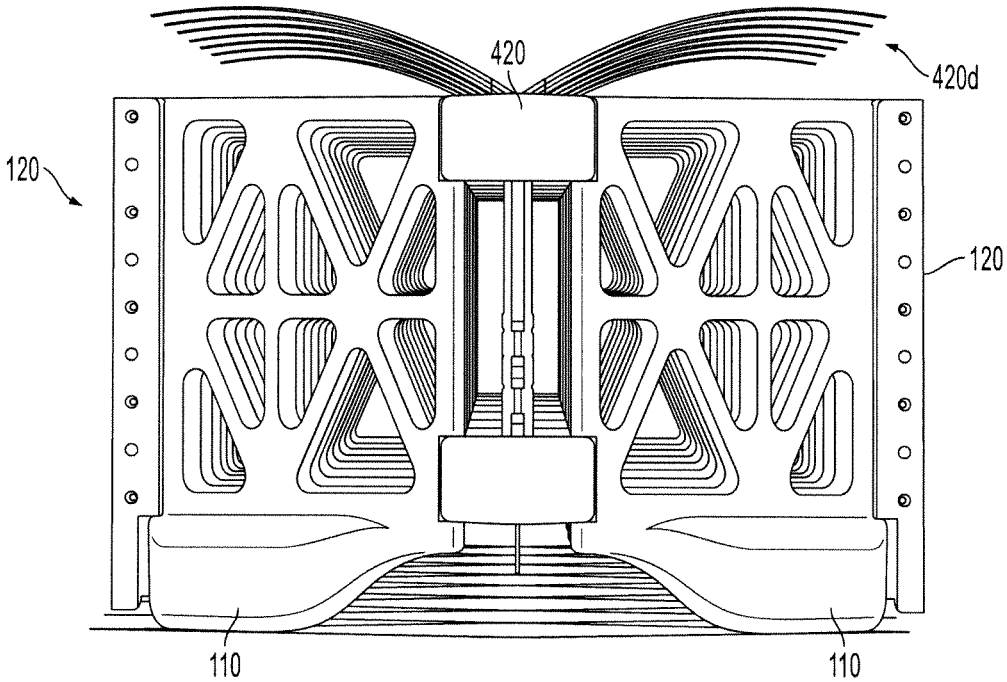
FIG. 4*c* is an end view of the barrier of FIG. 4*a*.

The present disclosure applies to a floating marine barrier, an exemplary embodiment of which is shown in FIG. 4*a*. Barrier 400 comprises a number of panels 110 joined together by rows of outboard hinges 120 and inboard hinges 420. Sets of steel impact cables 430 are attached to the rows of outboard hinges 120. When a vessel (not shown) impacts the outboard steel cables 430 on one side of the barrier, the cables begin to deflect towards the central row of hinges 420. The steel cables 430 have a very low elongation and will stretch only a few feet before the ends of the barrier 400 hold fast. As the cables 430 are pushed towards the central row of hinges 420, they begin to draw the panels 110 immediately adjacent to the point of impact around the vessel's beam. As the panels 110 are drawn in, the subsurface portion of each panel engages the water immediately surrounding it. The water offers resistance to the panel's motion through the water, which in turn offers resistance to the vessel's forward motion.

As the panels 110 in the immediate area of impact begin to collapse around the vessel, the hinges 120 which join panels 110 together begin to draw in around the point of impact, expanding or radiating the force of impact throughout the barrier 400. Previously-calm pools of water trapped within the subsurface portions of the diamond shapes of the barrier 400 become enraged and turbulent, offering additional resistance to the drawing of the vessel's impact. The entire barrier 400 becomes engaged to stop the vessel's forward motion. The panels' 110 flat and sloped sides act as anchors in the water when the rapid motion of impact occurs. Further, since water is an incompressible fluid, the water trapped in a diamond of the barrier 400 when an impact occurs will be forced to upwell between the walls of the panels 110. The water level will rise due to this hydraulic action within the diamond. This upwelling of fluid will expend additional energy imparted to the barrier by a vessel impact.

Should the outboard steel cables 430 become disengaged during an impact in the open "V" of the barrier, the central hinges 420 stand in the path of an attacking vessel. Inboard hinges 420 include a metal column sheathed in protective marine coatings, and rubber hinge elements. The column also supports several cables, such as catenary and haul cables of significant girth, capable of arresting a vessel's forward motion. Should a vessel pass through the central column area and its cables, a second set of arrestor cables 430 awaits the vessel on the other side of the structure.

The outboard hinge 120 is a composite structure of rubber and metal. It maintains the vertical spacing of the steel arrestor cables 430, acts as a shock absorber to impact, and mechanically joins adjacent panels 110 to each other, forming a hinge allowing the efficient expansion and contraction of the barrier 400. The hinge 120 is shaped to deflect a direct impact upon the joint, guiding an attacking vessel nearly ninety degrees to either side of its apex, and facilitating the capture of an attacking vessel into the "open V" on either side of the outboard hinge 120.

Figure 1A:
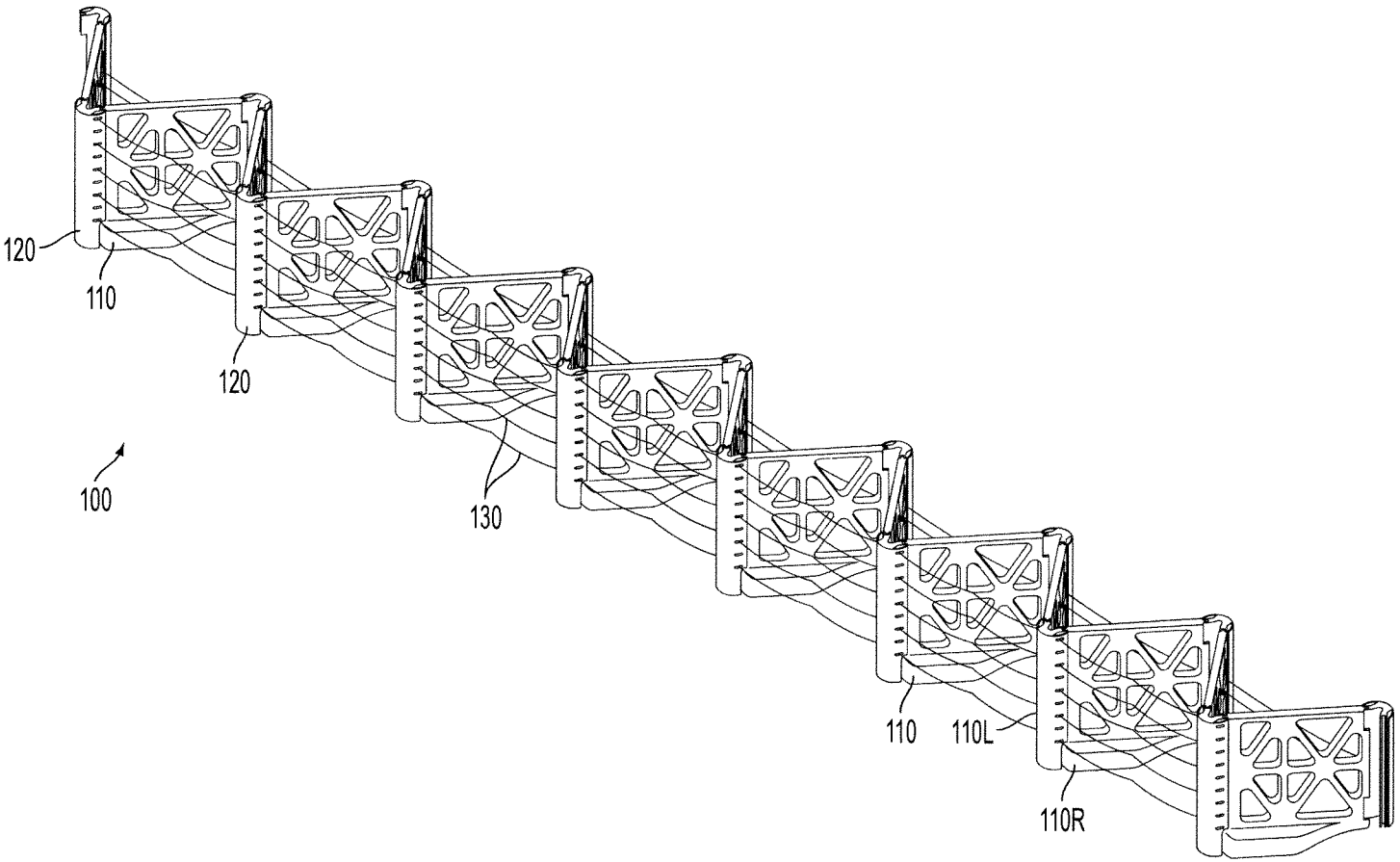
FIG. 1*a* is a perspective view of a marine barrier according to an embodiment of the present disclosure.
Figure 1B:
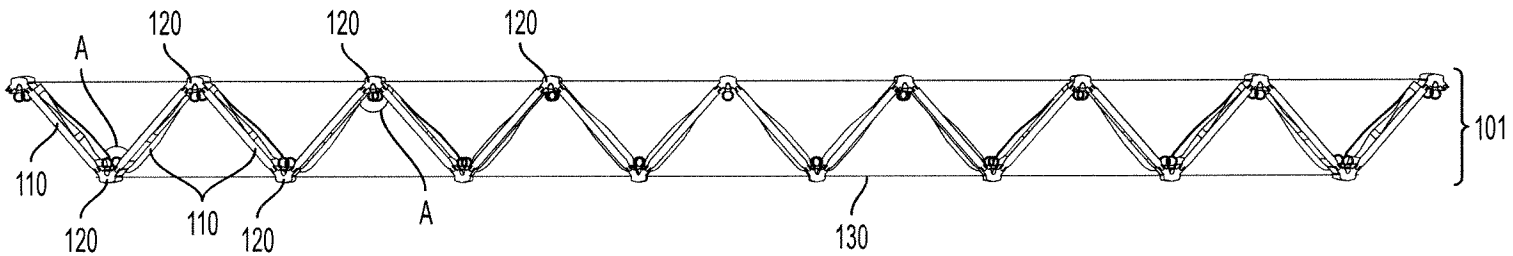
FIGS. 1*b* and 1*c* are top views of the barrier of FIG. 1*a*.

An embodiment of the disclosure will now be described in detail with reference to FIGS. 1*a-c*. A marine barrier 100 comprises a first plurality of substantially vertical panels 110 assembled to form a zig-zag shaped (i.e., pleated) barrier, each of the panels 110 having a pair of opposing sides 110R and 110L. Referring to FIGS. 2*a-b*, each of the panels 110 includes a frame 111 comprising metal and having a plurality of through holes 112 extending from one major surface to another major surface for allowing passage of water and wind through the panel, a plastic coating 113 encapsulating the frame 111, and an integral buoyancy portion 114 at the bottom of the frame 111. In an alternative embodiment shown in FIG. 2*c*, a panel 110*a* includes a buoyancy portion 114*a* that is a separate structure attached to a plastic-coated frame 111*a*.

Referring again to FIGS. 1*a-b*, a plurality of hinges 120 each elastically connect an outboard side of a first one of the panels 110 to a side of an adjacent second one of the panels 110 with an included angle A therebetween, to form a buoyant continuous first pleated row of panels 101, such that the outboard hinges 120 are arranged in first and second substantially parallel rows. A plurality of impact cables 130 are attached to opposing ends of the first pleated row of panels 101 and pass through each of the hinges 120 in the first row of hinges. In the embodiment shown in FIG. 1*c*, there are five impact cables 130, and they are substantially parallel to each other. Impact cables 130 comprise, for example, steel wire rope.

Figure 1C:
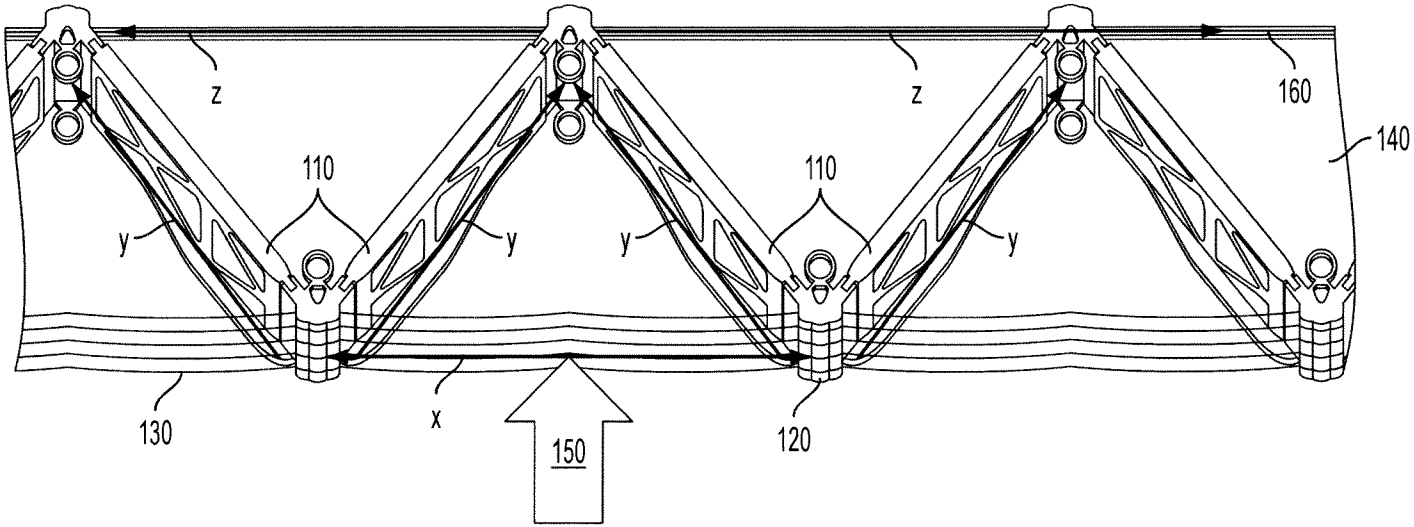
Figure 2A:
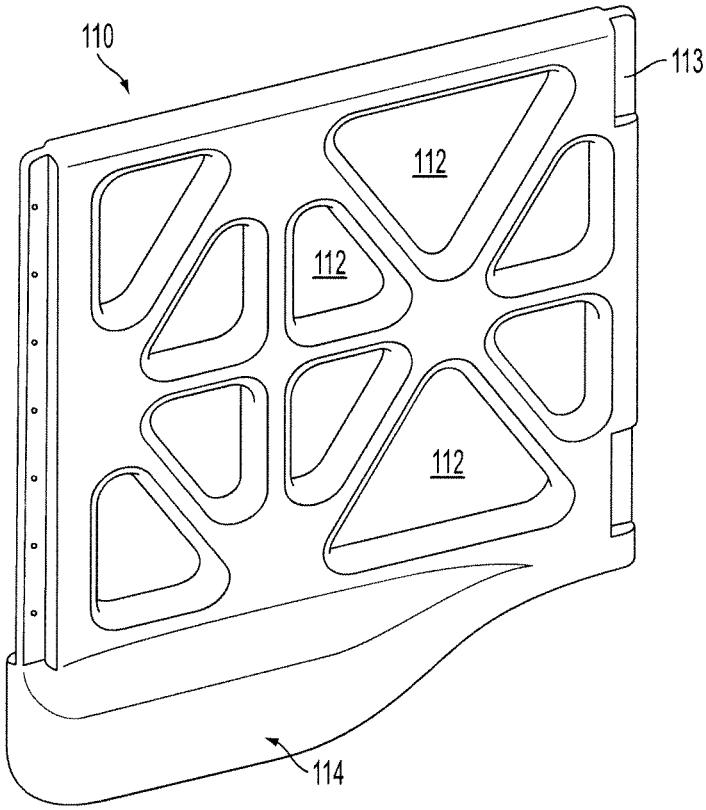
FIGS. 2*a-c* are views of buoyant panels according to the present disclosure.
Figure 2B:
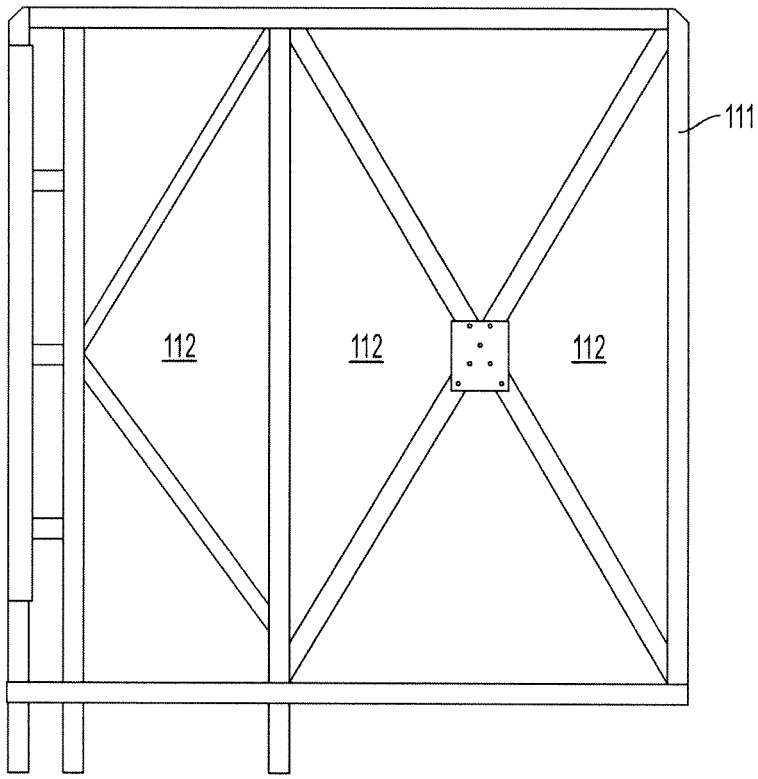
Figure 2C:
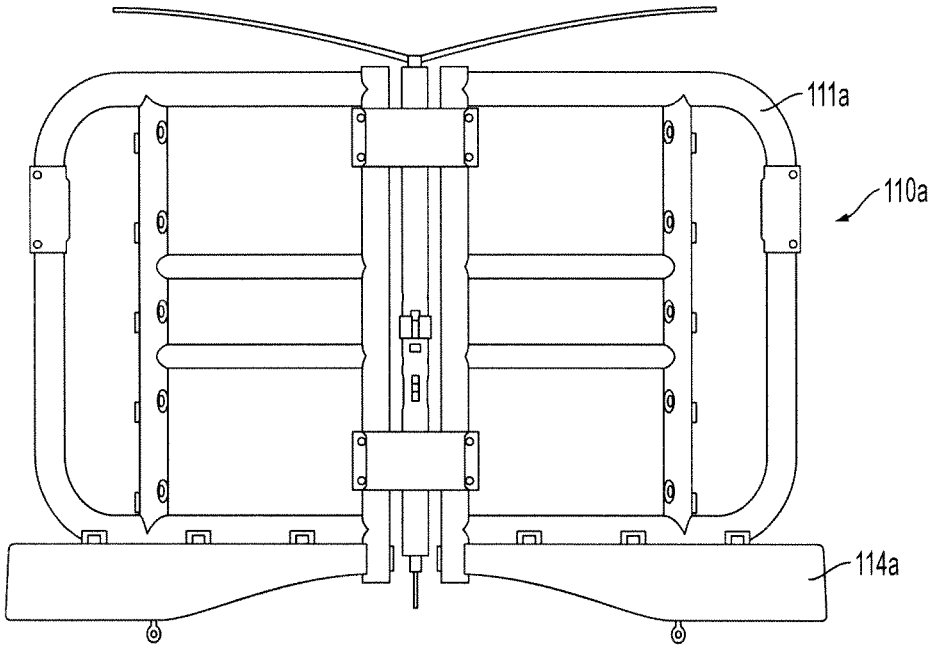

Referring now to FIG. 1*c*, when the barrier 100 is floating in a body of water 140 and a moving vessel, represented by arrow 150, impacts one or more of the impact cables 130, the impact cables 130 deflect to transfer a force of the impact to one or more of the first plurality of panels 110, which in turn engage the water 140 to transfer the force of the impact to the water 140, to arrest the motion of the vessel. The load path of the impact force of the moving vessel is shown in FIG. 1*c* by lines X, Y, and Z, representing the impact force as it moves from the impact cables 130 (line X) to the panels 110 (line Y) and the hinges 120 (lines X and Z). Thus, during an impact the panels 110 are drawn in around the point of impact and engage the water to dissipate the impact force.

Figure 3A:
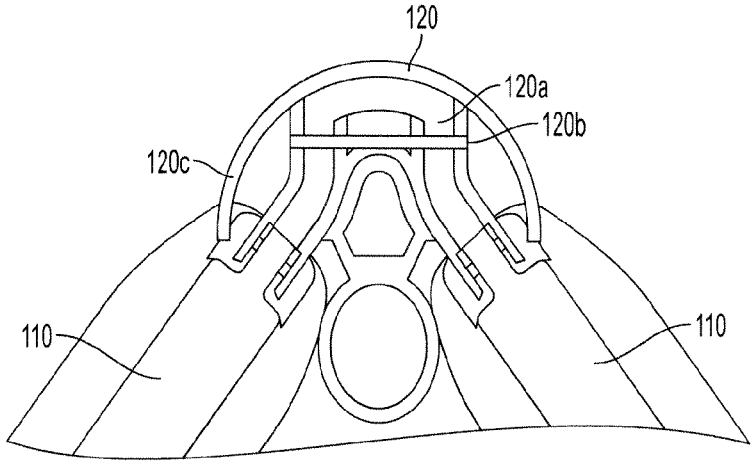
FIGS. 3*a-c* are views of an outboard hinge according to the present disclosure.
Figure 3B:
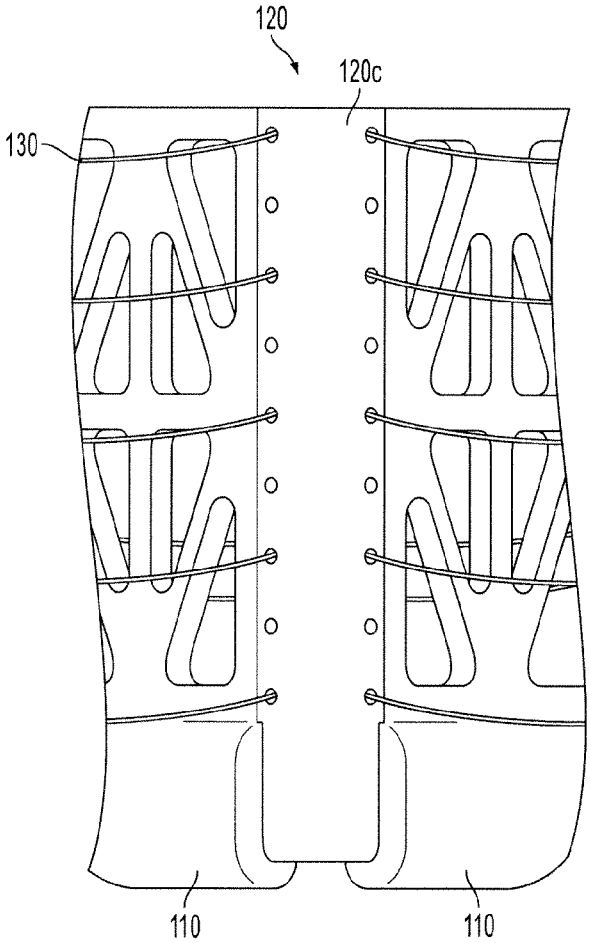
Figure 3C:
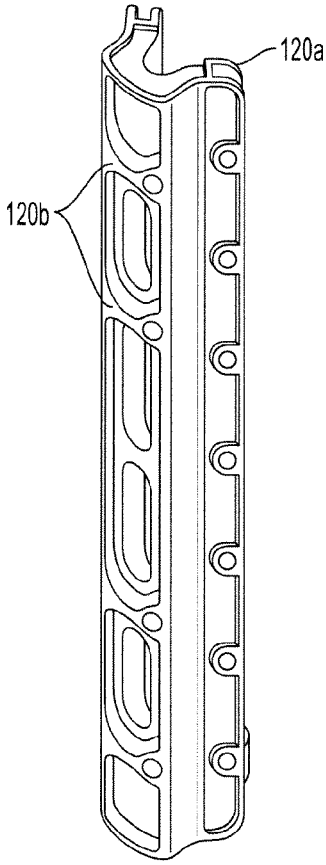

As shown in FIGS. 3*a-c*, outboard hinges 120 each comprise a core 120*a* of an elastic material for attaching to the side of the first one of the panels 110 and to the side of the second one of the panels 110, with the included angle A therebetween, the core 120*a* having a passageway 120*b* for the impact cables 130. An outer shell 120*c* is provided for attaching to and covering a portion of the core 120*a* proximal the passageway 120*b*, and for engaging the first and second ones of the panels 110, such that when the barrier 100 is floating in the body of water and a vessel impacts the outer shell 120*c* of one of the outboard hinges 120, the outer shell 120*c* guides the vessel into engagement with the impact cables 130. In certain embodiments, the core 120*a* comprises EPDM rubber having a Durometer value of about 60 to about 70, and the outer shell 120*c* comprises high density polyethylene.

Due to their elasticity, hinges 120 enable the panels 110 to move from an expanded position where adjacent ones of the panels 110 are disposed with the included angle A therebetween, to a retracted position where the panels 110 are substantially parallel to each other. A cable 160 is attached to an end hinge of one of the rows of hinges 120 and passes through the other hinges 120 of that row of hinges, for moving the panels 110 from the expanded position to the retracted position. Since the disclosed barrier is retractable, it can be used as a gate; for example, to allow vessels to pass into and out of an area protected by the barrier.

Another embodiment of the present disclosure will now be described with reference to FIGS. 4*a-e*. In this embodiment, a marine barrier 400 includes two continuous pleated rows 401, 402 of first and second respective pluralities of the panels 110, to form a diamond-shaped barrier. A plurality of the outboard hinges 120, and a plurality of inboard hinges 420 (which will be further described herein below) elastically connect opposing sides of adjacent panels 110 with the included angle A therebetween to form the continuous pleated rows 401, 402, such that the hinges 120, 420 are arranged in first, second, and third substantially parallel rows 410*a-c*.

A first plurality of impact cables 430 are attached to opposing ends of the first pleated row of panels 401 and pass through each of the hinges 120 in the first row of hinges 410*a*. A second plurality of impact cables 430 are attached to opposing ends of the second pleated row of panels 402 and pass through each of the hinges 120 in the third row of hinges 410*c*. In this embodiment, there are five impact cables 430 associated with each of the pleated rows 401, 402, and they are substantially parallel to each other. Impact cables 430 comprise, for example, steel wire rope.

Figure 4D:
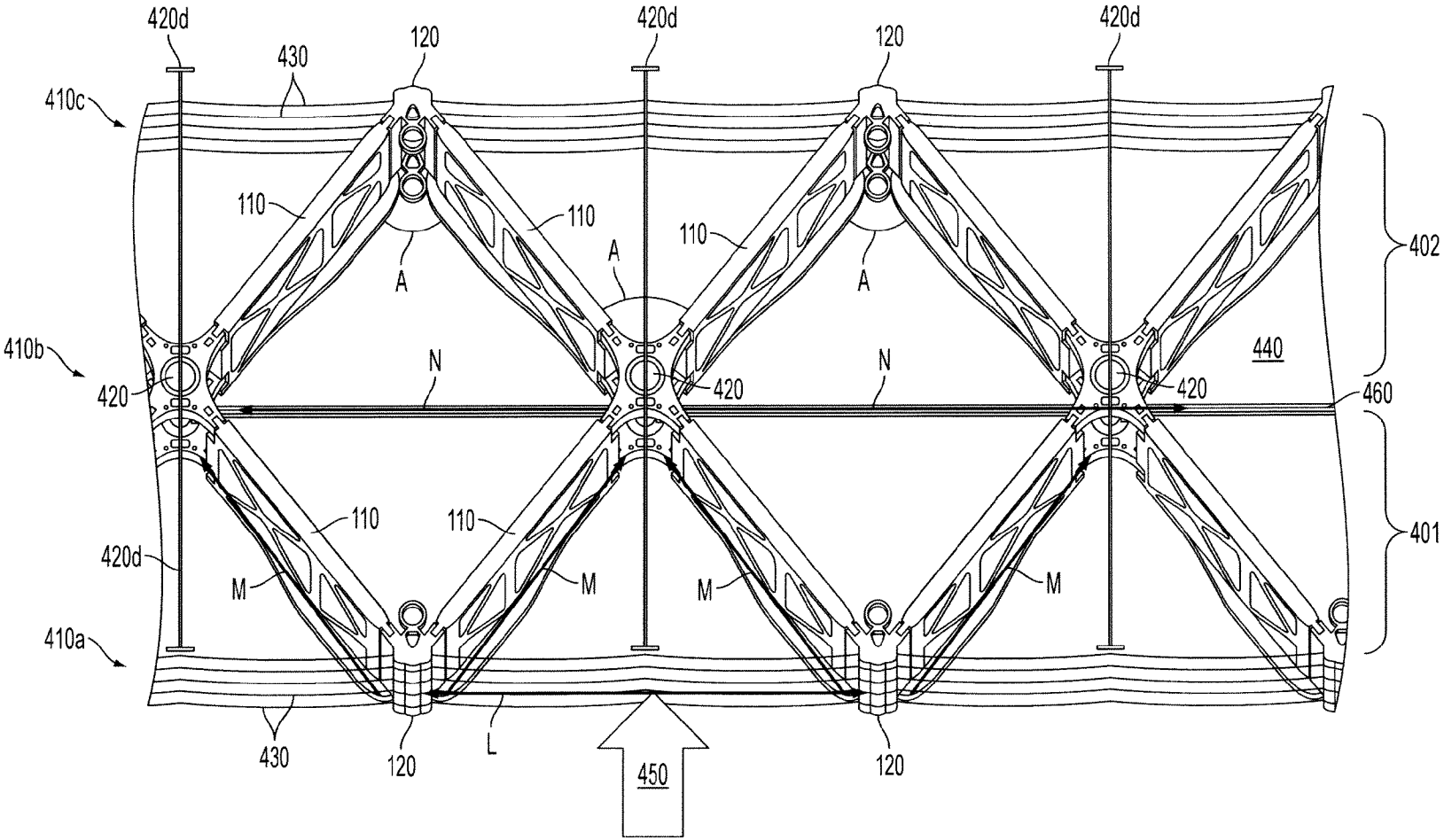
Figure 4E:
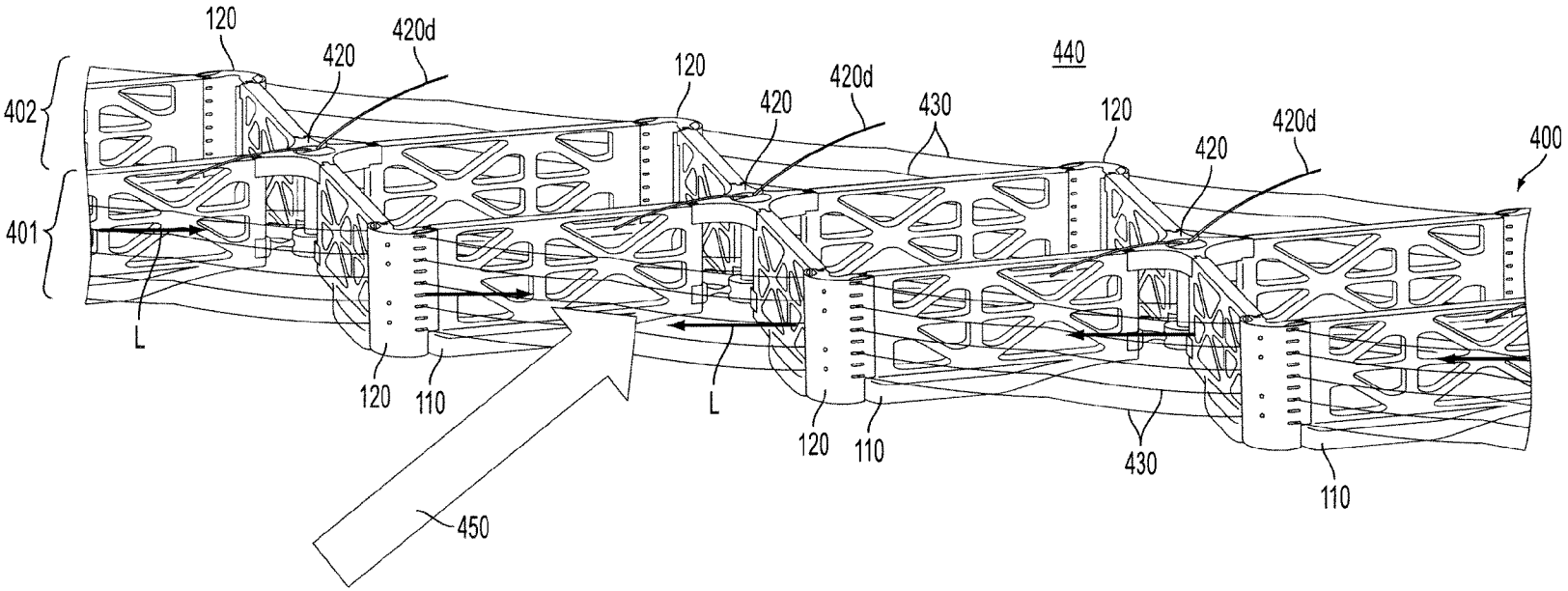

Referring now to FIGS. 4*d-e*, when the barrier 400 is floating in a body of water 440 and a moving vessel (represented by arrow 450) impacts one or more of the first plurality of impact cables 430 attached to the first pleated row 401 of panels 110, the impact cables 430 deflect to transfer a force of the impact to one or more of the first plurality of panels 110 of the first pleated row 401, which in turn engage the water 440, and to one or more of the second plurality of panels of the second pleated row 402, which in turn engage the water 440, to transfer the force of the impact to the water 440 and arrest the motion of the vessel. The load path of the impact force of the moving vessel is shown in FIGS. 4*d-e* by lines L, M, and N, representing the impact force as it moves from the impact cables 130 (lines L) to the panels 110 (lines M) and the hinges 120 and 420 (lines L and N).

Likewise, if a vessel impacts one or more of the second plurality of impact cables 430 attached to the second pleated row 402, the load path of the impact force will be similar, but in an opposite direction to lines L, M, N. shown in FIGS. 4*d-e*. Thus, during an impact the panels 110 are drawn in around the point of impact and engage the water to dissipate the impact force.

Figure 5:
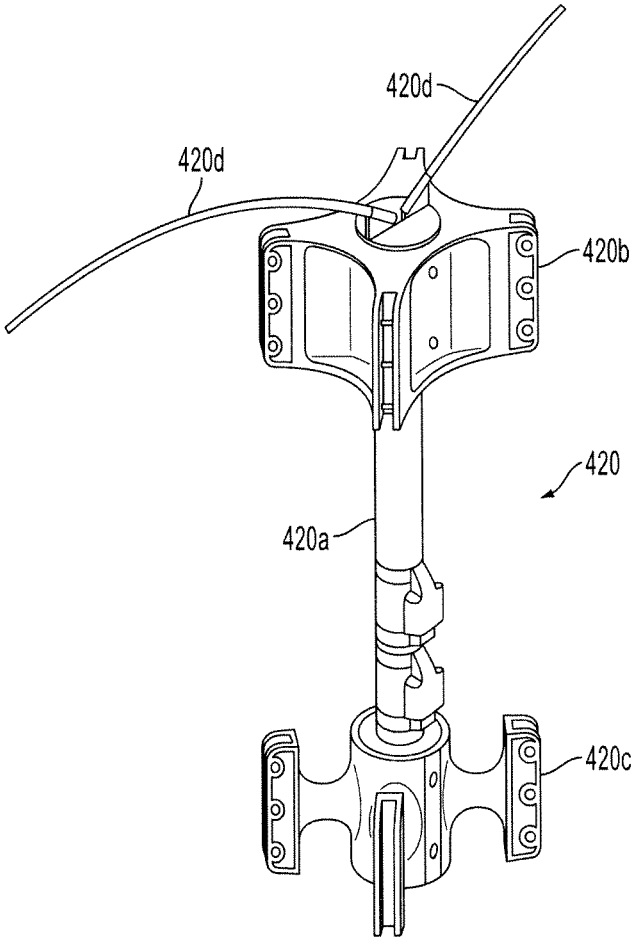
FIG. 5 depicts an inboard hinge according to the present disclosure.

Inboard hinges 420 will now be described with reference to FIG. 5. Each inboard hinge 420 is for joining four panels 110 together, and includes a vertical metal column 420*a* and a plurality of ligaments 420*b*, 420*c* attached to the column 420*a*, as by bolts. Each ligament 420*b*, 420*c* is for attaching to a side of each of four of the panels 110. For example, column 420*a* is a 5086 aluminum column with a marine coating (more specifically, a 12-inch or 6-inch Schedule 40 pipe). Ligaments 420*b*, 420*c* comprise EDPM rubber. The top ligament 420*b* has a whip 420*d* for engaging one or more of the impact cables 430 between two of the outboard hinges 120 of a row 410*a, c* of outboard hinges 120 to support the impact cable(s). Whips 420*d* perform cable management functions such as keeping cables 430 out of the water when the barrier is being assembled or is in its retracted position, and put a slight tension on cables 430 to prevent sagging and tangling.

Like the outboard hinges 120, inboard hinges 420 are elastic to enable the panels 110 to move from an expanded position where adjacent ones of the panels 110 are disposed with the included angle A therebetween, to a retracted position where the panels 110 are substantially parallel to each other. A cable 460 is attached to an end hinge of the row of inboard hinges 420 and passes through the other hinges 420 of that row of hinges, for moving the panels 110 from the expanded position to the retracted position. In one example, the barrier 400 using the panels 110 of FIG. 2*a* is about 30 meters long in the expanded position shown in FIG. 4*a*, with a height of about 2.4 meters, a beam of 4.7 meters, and a draft of 0.35 meters; barrier 400 weighs about 7700 Kg.

Figure 6A:
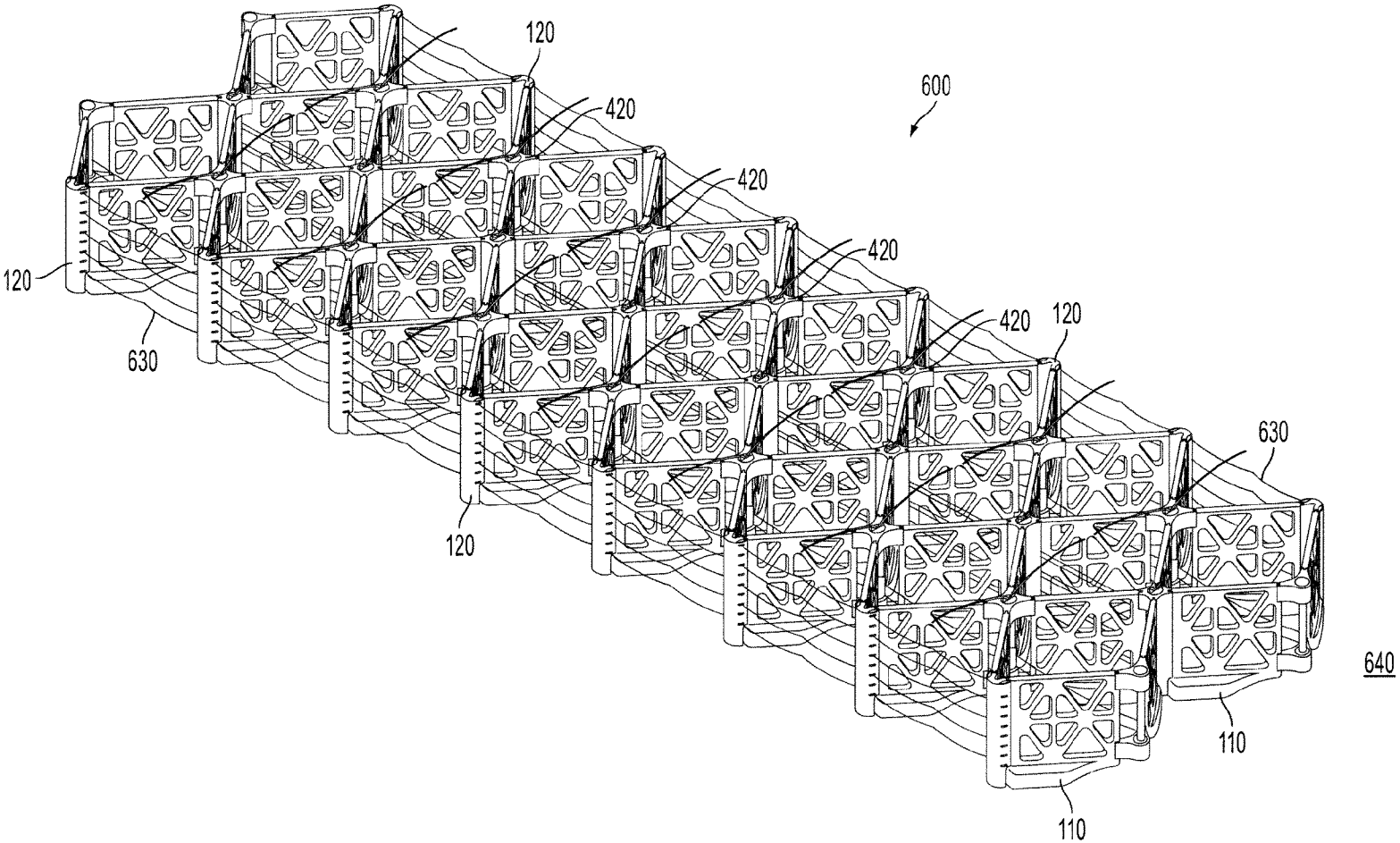
FIG. 6*a* is a perspective view of a barrier according to another embodiment of the present disclosure.
Figure 6B:
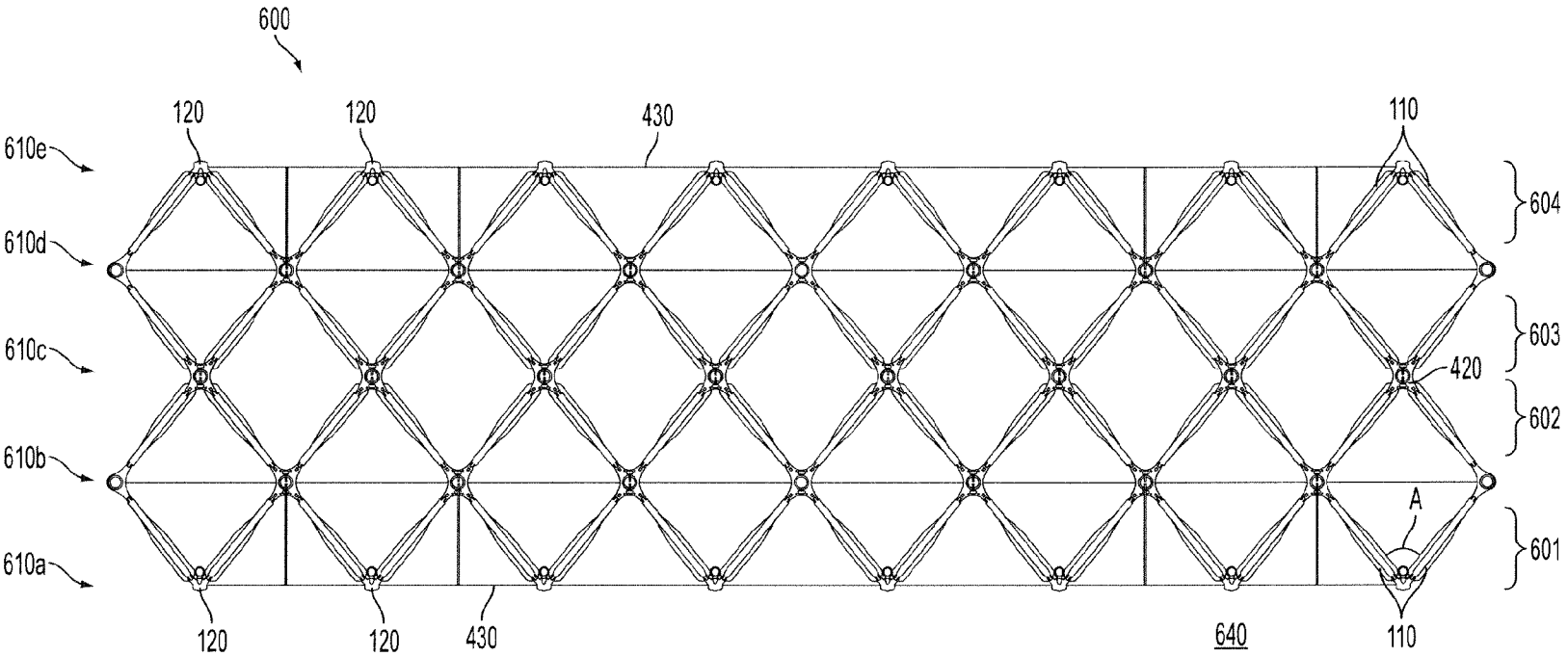
FIG. 6*b* is a top view of the barrier of FIG. 6*a*.
Figure 6C:
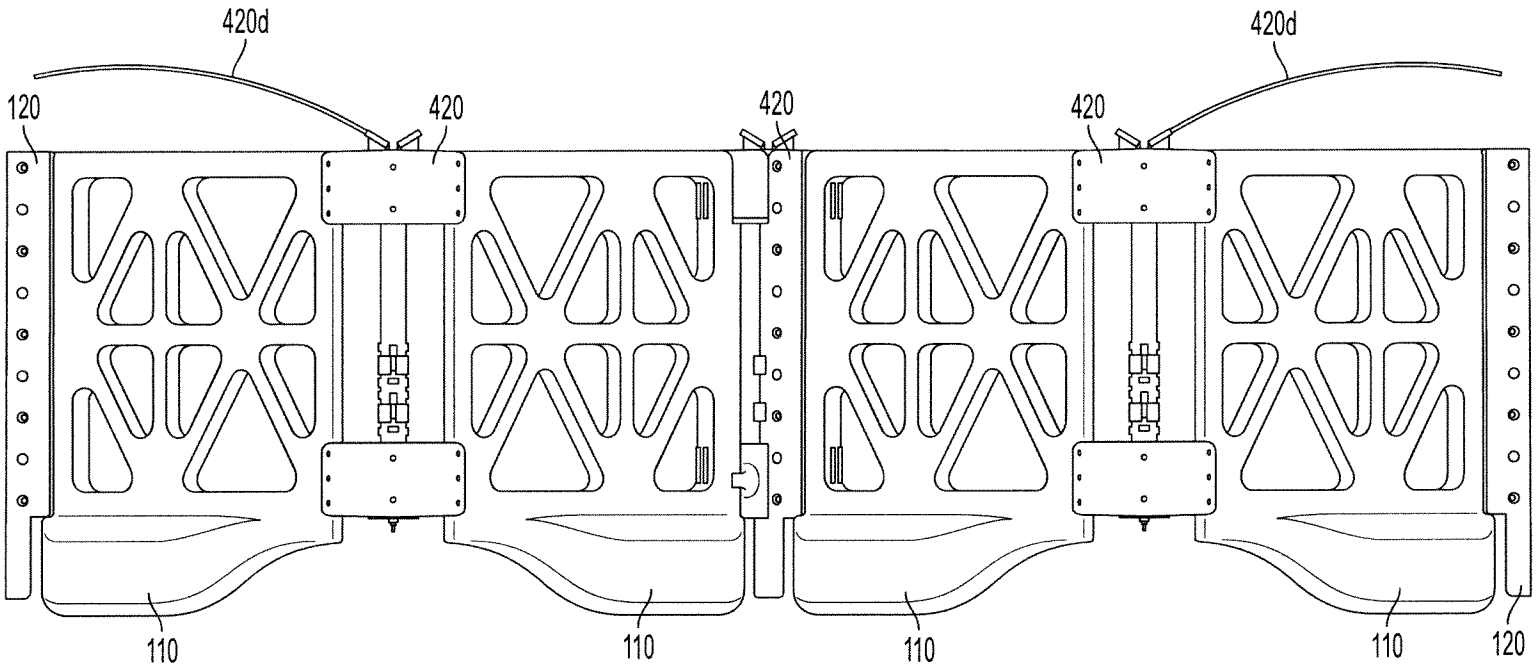
FIG. 6*c* is an end view of the barrier of FIG. 6*a*.

Another embodiment of the present disclosure will now be described with reference to FIGS. 6*a-c*. In this embodiment, a marine barrier 600 includes four continuous pleated rows 601-604 of first through fourth respective pluralities of the panels 110, to form a double diamond-shaped barrier. A plurality of the outboard hinges 120, and a plurality of the inboard hinges 420 elastically connect opposing sides of adjacent panels 110 with the included angle A therebetween to form the continuous pleated rows 601-604, such that the hinges 120, 420 are arranged in first, second, third, fourth, and fifth substantially parallel rows 610*a-e*.

More specifically, barrier 600 comprises the first pleated row 601 of panels, which are joined by outboard hinges 120 of the first row of hinges 610*a* and inboard hinges 420 of the second row of hinges 610*b*. Each of the inboard hinges 420 of the second row of hinges 610*b* also elastically connect a side of an additional one of the panels 110 to a side of an adjacent further additional one of the panels 110 with the included angle A therebetween. The barrier 600 further comprises a third row of hinges 610*c*, including a plurality of the inboard hinges 420, substantially parallel to the second row of hinges 601*b*; a second plurality of the panels 110, each of which has its pair of opposing sides respectively connected to hinges of the second and third rows of hinges 610*b*, 610*c* to form a second continuous pleated row 602 of panels; a fourth row of hinges 610*d*, including a plurality of the inboard hinges 420, substantially parallel to the third row of hinges 610*c*; a third plurality of the panels 110, each of which has its pair of opposing sides respectively connected to hinges of the third and fourth row of hinges 610*c*, 610*d* to form a third continuous pleated row of panels 603; a fifth row of hinges 610*e* substantially parallel to the fourth row of hinges 610*d*, each hinge of the fifth row of hinges 610*e* being for elastically connecting a side of a first one of the panels 110 to a side of an adjacent second one of the panels 110 with the included angle A therebetween; and a fourth plurality of the panels 110, each of which has its pair of opposing sides respectively connected to hinges of the fourth and fifth row of hinges 610*d*, 610*e* to form a fourth continuous pleated row of panels 604.

A first plurality of impact cables 630 are attached to opposing ends of the first pleated row of panels 601 and pass through each of the hinges 120 in the first row of hinges 610*a*. A second plurality of impact cables 630 are attached to opposing ends of the fourth pleated row of panels 604 and pass through each of the hinges 120 in the fifth row of hinges 610*e*. In this embodiment, there are five impact cables 630 associated with each of pleated rows 601, 604, and they are substantially parallel to each other. Impact cables 630 comprise, for example, steel wire rope.

When the barrier 600 is floating in a body of water 640 and a moving vessel impacts one or more of the first plurality of impact cables 630 attached to the first pleated row 601 of panels 110, the impact cables 630 deflect to transfer a force of the impact to one or more of the first plurality of panels 110 of the first pleated row 601, which in turn engage the water 640, and to one or more of the second plurality of panels of the second pleated row 602, which in turn engage the water 640, to transfer the force of the impact to the water 640 and arrest the motion of the vessel. The load path of the impact force of the moving vessel is the same as shown in FIGS. 4*d-e* by lines L, M, and N, representing the impact force as it moves from the impact cables 130 (lines L) to the panels 110 (lines M) and the hinges 120 and 420 (lines L and N). If the impact force is great enough, it will also be transmitted to the third plurality of panels 110 of the third pleated row 603 and to the fourth plurality of panels 110 of the fourth pleated row 604, and then to the water 640.

Likewise, if a vessel impacts one or more of the second plurality of impact cables 630 attached to the fourth pleated row 604, the load path of the impact force will be similar, but in an opposite direction. Thus, during an impact the panels 110 are drawn in around the point of impact and engage the water to dissipate the impact force.

Figure 7:
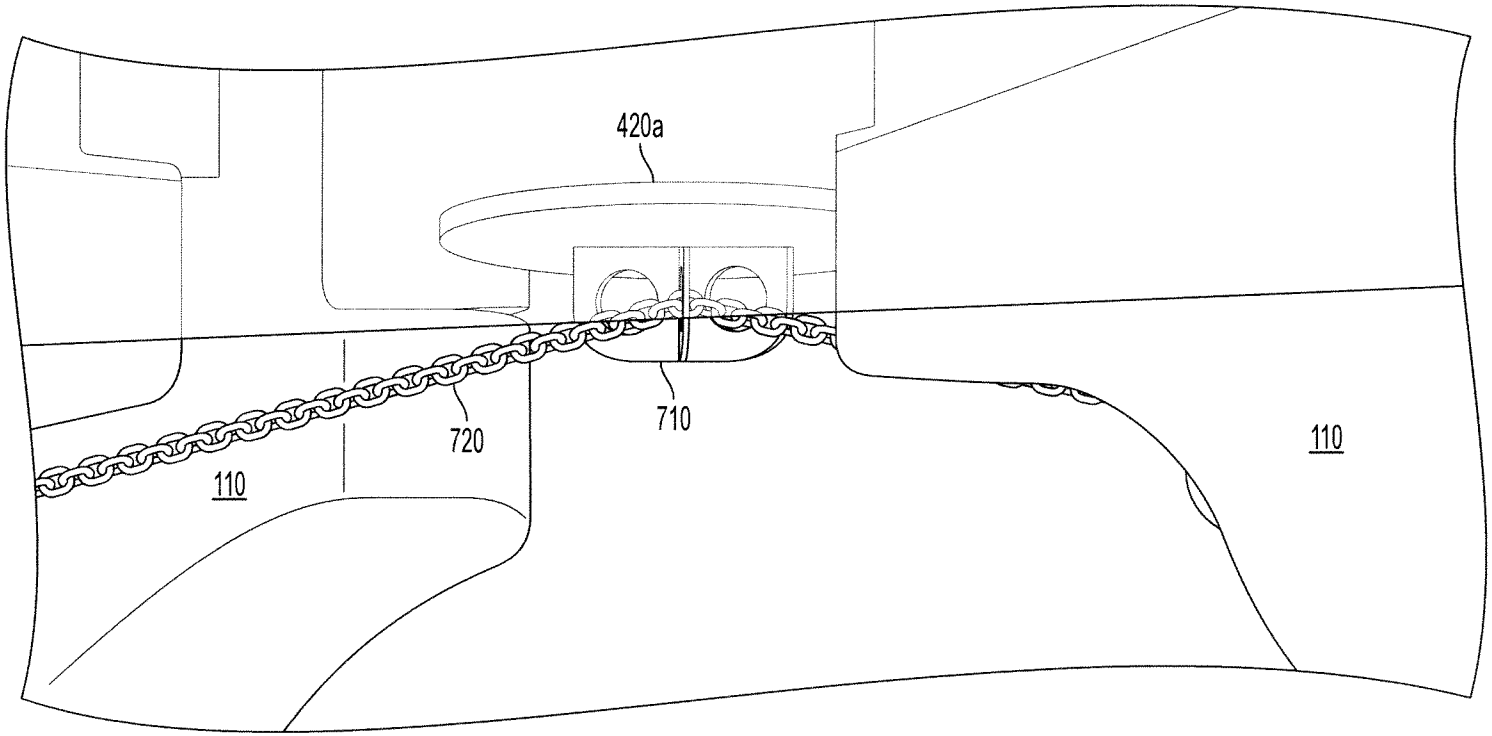
FIG. 7 depicts a chain attachment arrangement according to the present disclosure.

In certain embodiments of the disclosure, the vertical column 420*a* of each inboard hinge 420 of a row of hinges 420 has a chain attachment portion 710 at its bottom end, as shown in FIG. 7. In this case, the diamond barrier of the embodiment of FIGS. 4*a-e* further comprises a chain 720 extending substantially parallel to the second row of hinges 410*b* and attached to the chain attachment portion 710 of each inboard hinge 420, to limit motion of the inboard hinges 420 relative to each other when the barrier 400 is floating in the body of water 440. Likewise, in this case the double diamond barrier of FIGS. 6*a-c* further comprises a chain 720 extending substantially parallel to at least one of the second, third, and fourth rows of hinges 610*b-d* and attached to the chain attachment portion 710 of each inboard hinge 420 of the at least one row of hinges 420, to limit motion of the inboard hinges 420 relative to each other when the barrier 600 is floating in the body of water 640.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present teachings. However, it should be recognized that the present teachings can be practiced without resorting to the details specifically set forth. In other instances, well known processing structures have not been described in detail, in order not to unnecessarily obscure aspects of the present teachings.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A marine barrier comprising:

a first plurality of substantially vertical panels, each of the panels having a buoyant bottom portion, a pair of opposing sides, and a plurality of through holes extending from one major surface to another major surface for allowing passage of water and wind through the panel;

a plurality of hinges, each hinge for elastically connecting a side of a first one of the panels to a side of an adjacent second one of the panels with an included angle therebetween, to form a buoyant continuous first pleated row of panels, such that the hinges are arranged in first and second substantially parallel rows; and an impact cable attached to opposing ends of the first pleated row of panels and passing through each of the hinges in the first row of hinges; wherein when the barrier is floating in a body of water and a moving vessel impacts the impact cable, the impact cable deflects to transfer a force of the impact to one or more of the first plurality of panels, which in turn engage the water to transfer the force of the impact to the water, to arrest the motion of the vessel.

2. The marine barrier of claim 1, wherein each of the hinges of the first row of hinges is an outboard hinge comprising:

a core of an elastic material for attaching to the side of the first one of the panels and to the side of the second one of the panels, with the included angle therebetween, the core having a passageway for the impact cable; and an outer shell for attaching to and covering a portion of the core proximal the passageway, and for engaging the first and second ones of the panels, such that when the barrier is floating in the body of water and a vessel impacts the outer shell of one of the outboard hinges, the outer shell guides the vessel into engagement with the impact cable.

3. The marine barrier of claim 2, wherein the core comprises EPDM rubber having a Durometer value of about 60 to about 70, and the outer shell comprises high density polyethylene.

4. The marine barrier of claim 1, comprising a plurality of the impact cables, each attached to opposing ends of the first pleated row of panels and passing through each of the hinges in the first row of hinges.

5. The marine barrier of claim 4, wherein the impact cables are substantially parallel to each other.

6. The marine barrier of claim 1, wherein each of the panels comprises:

a frame comprising metal and having the plurality of through holes;

a plastic coating encapsulating the frame; and a buoyancy portion at the bottom of the frame.

7. A marine barrier, comprising:

a first plurality of substantially vertical panels, each of the panels having a buoyant bottom portion and a pair of opposing sides;

a plurality of hinges, each hinge for elastically connecting a side of a first one of the panels to a side of an adjacent second one of the panels with an included angle therebetween, to form a buoyant continuous first pleated row of panels, such that the hinges are arranged in first and second substantially parallel rows; and an impact cable attached to opposing ends of the first pleated row of panels and passing through each of the hinges in the first row of hinges;

wherein when the barrier is floating in a body of water and a moving vessel impacts the impact cable, the impact cable deflects to transfer a force of the impact to one or more of the first plurality of panels, which in turn engage the water to transfer the force of the impact to the water, to arrest the motion of the vessel;

wherein the second row of hinges are inboard hinges, each of which are for joining four of the panels together by elastically connecting a side of an additional one of the panels to a side of an adjacent further additional one of the panels with the included angle therebetween, the barrier further comprising:

a third row of hinges substantially parallel to the second row of hinges;

a second plurality of the panels, each of which has its pair of opposing sides respectively connected to hinges of the second and third row of hinges to form a second continuous pleated row of panels; and a second impact cable attached to opposing ends of the second pleated row of panels and passing through each of the hinges in the third row of hinges;

wherein when the barrier is floating in the body of water and a moving vessel impacts the second impact cable, the second impact cable deflects to transfer a force of the impact to one or more of the second plurality of panels, which in turn engage the water, and to one or more of the first plurality of panels, which in turn engage the water, to transfer the force of the impact to the water and arrest the motion of the vessel.

8. The marine barrier of claim 7, wherein each inboard hinge comprises:

a vertical column comprising metal; and a plurality of ligaments comprising EPDM rubber attached to the column, wherein each ligament is for attaching to a side of each of four of the panels.

9. The marine barrier of claim 8, wherein one of the ligaments has a whip for engaging one of the impact cables between two of the hinges of the first row of hinges to support the impact cable.

10. The marine barrier of claim 8, wherein the vertical column of each inboard hinge has a chain attachment portion;

the barrier further comprising a chain extending substantially parallel to the second row of hinges and attached to the chain attachment portion of each inboard hinge, to limit motion of the inboard hinges relative to each other when the barrier is floating in the body of water.

11. A marine barrier, comprising:

a first plurality of substantially vertical panels, each of the panels having a buoyant bottom portion and a pair of opposing sides;

a plurality of hinges, each hinge for elastically connecting a side of a first one of the panels to a side of an adjacent second one of the panels with an included angle therebetween, to form a buoyant continuous first pleated row of panels, such that the hinges are arranged in first and second substantially parallel rows; and an impact cable attached to opposing ends of the first pleated row of panels and passing through each of the hinges in the first row of hinges;

wherein when the barrier is floating in a body of water and a moving vessel impacts the impact cable, the impact cable deflects to transfer a force of the impact to one or more of the first plurality of panels, which in turn engage the water to transfer the force of the impact to the water, to arrest the motion of the vessel;

wherein the second row of hinges are inboard hinges, each of which are for joining four of the panels together by elastically connecting a side of an additional one of the panels to a side of an adjacent further additional one of the panels with the included angle therebetween, the barrier further comprising:

a third row of hinges, including a plurality of the inboard hinges, substantially parallel to the second row of hinges;

a second plurality of the panels, each of which has its pair of opposing sides respectively connected to hinges of the second and third row of hinges to form a second continuous pleated row of panels;

a fourth row of hinges, including a plurality of the inboard hinges, substantially parallel to the third row of hinges;

a third plurality of the panels, each of which has its pair of opposing sides respectively connected to hinges of the third and fourth row of hinges to form a third continuous pleated row of panels;

a fifth row of hinges substantially parallel to the fourth row of hinges, each hinge of the fifth row of hinges being for elastically connecting a side of a first one of the panels to a side of an adjacent second one of the panels with the included angle therebetween;

a fourth plurality of the panels, each of which has its pair of opposing sides respectively connected to hinges of the fourth and fifth row of hinges to form a fourth continuous pleated row of panels; and a second impact cable attached to opposing ends of the fourth pleated row of panels and passing through each of the hinges in the fifth row of hinges;

wherein when the barrier is floating in the body of water and a moving vessel impacts the second impact cable, the second impact cable deflects to transfer a force of the impact to one or more of the fourth plurality of panels, which in turn engage the water, and to one or more of the first through third plurality of panels, which in turn engage the water, to transfer the force of the impact to the water and arrest the motion of the vessel.

12. The marine barrier of claim 11, comprising a plurality of the impact cables, each attached to opposing ends of the first pleated row of panels and passing through each of the hinges in the first row of hinges, and a plurality of the impact cables, each attached to opposing ends of the fourth pleated row of panels and passing through each of the hinges in the fifth row of hinges.

13. The marine barrier of claim 11, wherein each of the hinges of the first and fifth rows of hinges is an outboard hinge comprising:

a core of an elastic material for attaching to the side of the first one of the panels and to the side of the second one of the panels, with the included angle therebetween, the core having a passageway for a respective one of the impact cables; and an outer shell for attaching to and covering a portion of the core proximal the passageway, and for engaging the first and second ones of the panels, such that when the barrier is floating in the body of water and a vessel impacts the outer shell of one of the outboard hinges, the outer shell guides the vessel into engagement with a respective impact cable.

14. The marine barrier of claim 13, wherein the core comprises EPDM rubber having a Durometer value of about 60 to about 70, and the outer shell comprises high density polyethylene.

15. The marine barrier of claim 11, wherein each inboard hinge comprises:

a vertical column comprising metal; and a plurality of ligaments comprising EPDM rubber attached to the column, wherein each ligament is for attaching to a side of each of four of the panels.

16. The marine barrier of claim 15, wherein one of the ligaments has a whip for engaging one of the impact cables between two of the outboard hinges to support the impact cable.

17. The marine barrier of claim 15, wherein the vertical column of each inboard hinge of at least one of the second, third and fourth rows of hinges has a chain attachment portion;

the barrier further comprising a chain extending substantially parallel to the at least one of the second, third, and fourth rows of hinges and attached to the chain attachment portion of each inboard hinge of the at least one row of hinges, to limit motion of the inboard hinges relative to each other when the barrier is floating in the body of water.

18. The marine barrier of any one of claims 1, 7, and 11, wherein the impact cables comprise steel wire rope.

19. The marine barrier of any one of claims 1, 7, and 11, wherein the panels are movable from an expanded position where adjacent ones of the panels are disposed with the included angle therebetween, to a retracted position where the panels are substantially parallel to each other.

20. The marine barrier of claim 19, further including a cable attached to an end hinge of one of the rows of hinges and passing through the other hinges of that row of hinges, for moving the panels from the expanded position to the retracted position.

* * * * *